US009732634B2

(12) United States Patent
Hikichi et al.

(10) Patent No.: US 9,732,634 B2
(45) Date of Patent: Aug. 15, 2017

(54) RANKINE CYCLE DEVICE, EXPANSION SYSTEM AND EXPANSION MACHINE

(71) Applicant: Panasonic Intellectual Property Management Co., Ltd., Osaka (JP)

(72) Inventors: Takumi Hikichi, Osaka (JP); Osao Kido, Kyoto (JP); Atsuo Okaichi, Osaka (JP); Osamu Kosuda, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 229 days.

(21) Appl. No.: 14/657,185

(22) Filed: Mar. 13, 2015

(65) Prior Publication Data

US 2015/0184546 A1 Jul. 2, 2015

Related U.S. Application Data

(63) Continuation of application No. PCT/JP2014/001770, filed on Mar. 27, 2014.

(30) Foreign Application Priority Data

Apr. 9, 2013 (JP) ..... 2013-081060

(51) Int. Cl.
*F01K 7/16* (2006.01)
*F01K 25/08* (2006.01)
(Continued)

(52) U.S. Cl.
CPC ..... *F01K 7/16* (2013.01); *F01C 1/0215* (2013.01); *F01C 11/008* (2013.01); *F01C 21/06* (2013.01);
(Continued)

(58) Field of Classification Search
CPC ..... F01K 7/16; F01K 25/08; F01K 15/00; F01K 9/00; F01K 13/006; F01D 15/10;
(Continued)

(56) References Cited

U.S. PATENT DOCUMENTS 7,992,400 B2 8/2011 Uno et al.
8,839,622 B2 * 9/2014 Myers ..... F01K 3/00 310/52
(Continued)

FOREIGN PATENT DOCUMENTS

EP 2615266 7/2013
JP 2006-125771 5/2006
(Continued)

OTHER PUBLICATIONS

International Search Report of PCT application No. PCT/JP2014/001770 dated Jun. 17, 2014.
(Continued)

*Primary Examiner* — Hoang Nguyen
(74) *Attorney, Agent, or Firm* — McDermott Will & Emery LLP

(57) ABSTRACT

To improve the reliability of the Rankine cycle device using a sealed-type expansion machine, the Rankine cycle device 100 according to the present disclosure comprises a pump 1, a heater 2, an expansion machine 3, a radiator 5, and a cooling path 8. The expansion machine 3 comprises an expansion mechanism 11 for extracting a power from the working fluid, an electric power generator 12, a sealed container 10 containing the expansion mechanism 11 and the electric power generator 12, a first inlet 34*a*, a first outlet 35*a*, a second inlet 30*a*, and a second outlet 31*a*. The radiator 5 is connected to the pump 1 with a flow path to cool the working fluid drained from the second outlet 31*a*. The cooling path 8 which connects the first outlet 35*a* to the
(Continued)

second outlet 30*a* has a cooler 4 to cool the working fluid drained from the first outlet 35*a*.

18 Claims, 6 Drawing Sheets

(51) Int. Cl.

| | |
|---|---|
| ***F01C 1/02*** | (2006.01) |
| ***F01C 21/06*** | (2006.01) |
| ***F01C 21/18*** | (2006.01) |
| ***F01K 9/00*** | (2006.01) |
| ***F01K 13/00*** | (2006.01) |
| ***F01D 15/10*** | (2006.01) |
| ***F01K 15/00*** | (2006.01) |
| *F01C 11/00* | (2006.01) |

(52) U.S. Cl.
CPC ..... *F01C 21/18* (2013.01); *F01D 15/10* (2013.01); *F01K 9/00* (2013.01); *F01K 13/006* (2013.01); *F01K 15/00* (2013.01); *F01K 25/08* (2013.01); *F01C 11/00* (2013.01)

(58) Field of Classification Search
CPC ..... F01C 21/18; F01C 11/008; F01C 1/0215; F01C 21/06; F01C 11/00
USPC ..... 60/651, 670, 671
See application file for complete search history.

(56) References Cited

U.S. PATENT DOCUMENTS

| | | | | |
|---|---|---|---|---|
| 2004/0050052 | A1* | 3/2004 | Niikura | F01K 23/065 60/670 |
| 2004/0144093 | A1* | 7/2004 | Hanna | F01K 17/02 60/651 |
| 2008/0250789 | A1* | 10/2008 | Myers | F01K 3/00 60/645 |
| 2014/0110939 | A1 | 4/2014 | Takahashi et al. | |

FOREIGN PATENT DOCUMENTS

| | | |
|---|---|---|
| JP | 2009-121355 | 6/2009 |
| JP | 2009-138684 | 6/2009 |
| JP | 2009-174494 | 8/2009 |
| JP | 2011-196315 | 10/2011 |
| WO | 83/01482 | 4/1983 |
| WO | 2013/002066 | 1/2013 |

OTHER PUBLICATIONS

The Extended European Search Report dated Feb. 25, 2016 for the related European Patent Application No. 14782997.2.

* cited by examiner

RANKINE CYCLE DEVICE, EXPANSION SYSTEM AND EXPANSION MACHINE

BACKGROUND

1. Technical Field

The present invention relates to a Rankine cycle device, an expansion system and an expansion machine.

2. Description of the Related Art

In a general Rankine cycle device, an expansion machine is operated with a working fluid having a high temperature and a high pressure to generate an electric power with a power extracted from the working fluid by the expansion machine. The working fluid having a high temperature and a high pressure is made by a pump and a heat source such as solar heat, geothermal heat, or exhaust heat.

U.S. Pat. No. 7,418,824 discloses an expansion machine included in a Rankine cycle device. This expansion machine has a structure where a positive displacement expansion mechanism and an electric power generator which is connected to the positive displacement expansion mechanism with a shaft are contained in a sealed container. The expansion machine having such a structure does not require a mechanical seal to prevent the working fluid from leaking to the outside of the sealed container, since the shaft included in the expansion machine does not penetrate the sealed container.

Japanese Patent Application laid-open Publication No. 2009-174494A also discloses a Rankine cycle device 300 using an expansion machine having a similar structure. As shown in FIG. 6, the Rankine cycle device 300 has a pump 301, a heater 302, an expansion machine 303, and a cooler 305. The expansion machine 303 has an expansion mechanism 311, an electric power generator 312 connected to the expansion mechanism 311 with a shaft 313, and a sealed container 310 containing the expansion mechanism 311 and the electric power generator 312. A portion of a flow path leading the working fluid from the outlet of the pump 301 to the inlet of the heater 302 is located in the inside of the sealed container 310 so that the electric power generator 312 is located in the portion of the flow path. For this reason, since a relatively low temperature working fluid flows in or around the electric power generator 312, the electric power generator 312 is cooled by the working fluid.

SUMMARY

The efficiency of the Rankine cycle improves with an increase in the enthalpy of the working fluid in the inlet of the expansion machine. However, in the Rankine cycle device having such a sealed-type expansion machine, if the working fluid after the expansion has too high temperature, the electric power generator may be damaged. The purpose of the present invention is to improve the reliability of the Rankine cycle device having a sealed-type expansion machine.

The present disclosure provides a Rankine cycle device comprising:

- a pump for pressurizing a working fluid;
- a heater for heating the working fluid pressurized by the pump;
- an expansion machine comprising:
  - an expansion mechanism for extracting a power from the working fluid heated by the heater,
  - an electric power generator connected to the expansion mechanism,
  - a sealed container containing the expansion mechanism and the electric power generator,
  - a first inlet for supplying the working fluid to the expansion mechanism,
  - a first outlet for draining the working fluid from the expansion mechanism to an outside of the sealed container,
  - a second inlet for supplying, to an inside of the sealed container, the working fluid having a lower temperature than that of the working fluid at the first outlet, and
  - a second outlet for draining, to the outside of the sealed container, the working fluid supplied from the second inlet;
- a radiator for cooling the working fluid drained from the second outlet and for supplying the working fluid to the pump; and
- a cooling path having a cooler for cooling the working fluid drained from the first outlet, the cooling path connecting the first outlet to the second inlet.

The present disclosure improves reliability of a Rankine cycle device having a sealed-type expansion machine.

DETAILED DESCRIPTION OF EMBODIMENTS

Figure 1:
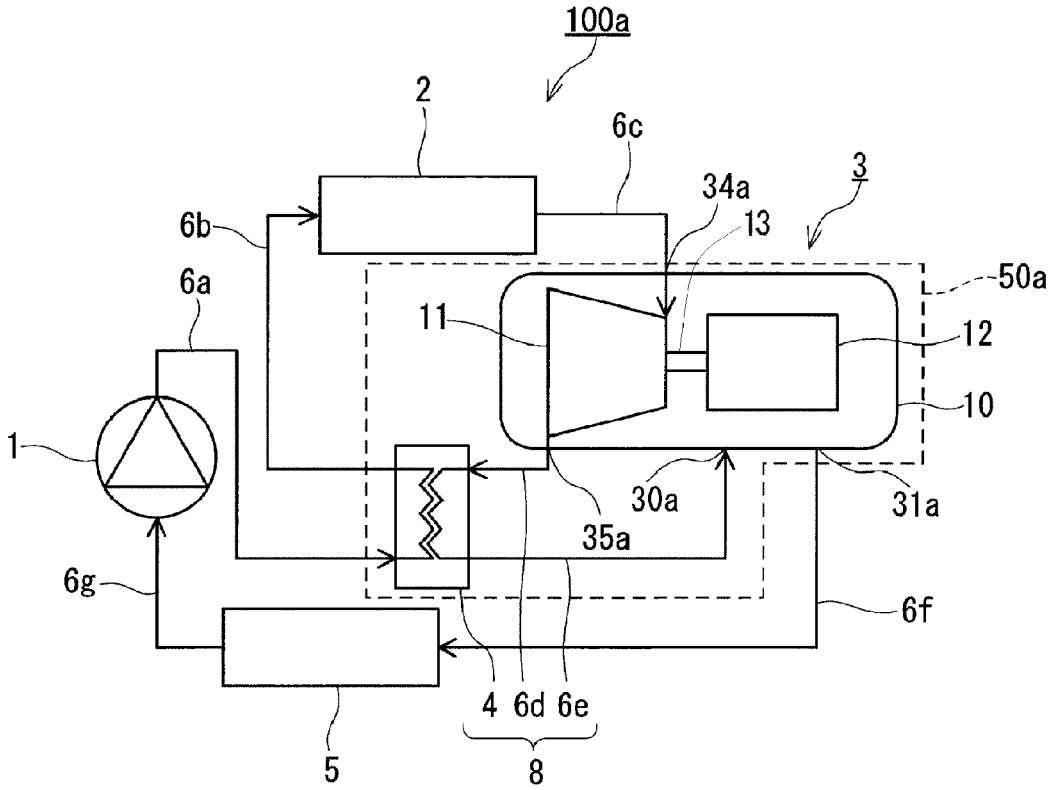
FIG. 1 shows a structural view of a Rankine cycle device according to a first embodiment of the present disclosure.

The theoretical efficiency of a Rankine cycle is increased with an increase in the enthalpy of the working fluid supplied to the expansion mechanism. In other words, it is desirable that the pressure and the temperature of the working fluid supplied to the expansion mechanism are as high as possible. In Japanese Patent Application laid-open Publication No. 2006-125771A, the internal space of the sealed container is filled with the working fluid which has been expanded. In this case, the electric power generator may be damaged due to the heat deterioration of the materials of the electric power generator, if the temperature of the expanded working fluid is too high. In addition, even if the temperature of the expanded working fluid falls within the acceptable range, the life of the electric power generator may be shortened, when the electric power generator is driven continuously at a high temperature. In addition, the demagnetization of the permanent magnet may occur when the permanent magnet is used for the electric power generator. For this reason, it may be conceivable to limit the temperature of the working fluid to be supplied to the expansion mechanism; however, such a limitation prevents the efficiency of the Rankine cycle device from being improved.

It may be conceivable to cool the electric power generator positively not only to achieve high cycle efficiency by supplying a high temperature working fluid to the expansion mechanism but also to prevent the electric power generator from being damaged. In Japanese Patent Application laid-open Publication No. 2009-174494A, as described above, the electric power generator 312 is cooled by the relatively low temperature working fluid flowing through the flow path from the outlet of the pump 301 to the inlet of the heater 302. In addition, since the working fluid flowing through the flow path from the outlet of the pump 301 to the inlet of the heater 302 is heated in advance by the heat of the electric power generator, the efficiency for the cycle is improved. For this reason, the high efficiency of the cycle is achieved, and the damage of the electric power generator is prevented.

However, the working fluid at the outlet of pump 301 of the Rankine cycle device 300 is in a liquid phase, depending on the kind of the working fluid and the operating conditions of the cycle. In this case, since the working fluid in the liquid phase is supplied around the electric power generator 312, the working fluid in the liquid phase is stirred by the action of the rotation of the electric power generator 312. A big loss occurs due to the stirring of the working fluid in the liquid phase. In addition, a leak electric current may be increased, since an electric current flows easily through the working fluid in the liquid phase compared to the working fluid in a gaseous phase. Furthermore, it is difficult to centrifuge the working fluid from lubricant oil using the rotation of the electric power generator, since a density difference between the working fluid and the lubricant oil is small.

A first aspect according to the present disclosure provides a Rankine cycle device comprising:

a pump for pressurizing a working fluid;

a heater for heating the working fluid pressurized by the pump;

an expansion machine comprising:

an expansion mechanism for extracting a power from the working fluid heated by the heater, an electric power generator connected to the expansion mechanism, a sealed container containing the expansion mechanism and the electric power generator, a first inlet for supplying the working fluid to the expansion mechanism, a first outlet for draining the working fluid from the expansion mechanism to an outside of the sealed container, a second inlet for supplying, to an inside of the sealed container, the working fluid having a lower temperature than that of the working fluid at the first outlet, and a second outlet for draining, to the outside of the sealed container, the working fluid supplied from the second inlet;

a radiator for cooling the working fluid drained from the second outlet and for supplying the working fluid to the pump; and a cooling path having a cooler for cooling the working fluid drained from the first outlet, the cooling path connecting the first outlet to the second inlet.

In the first aspect, the working fluid cooled by the cooler is supplied to the inside of the sealed container through the second inlet. Since the electric power generator is cooled by the working fluid cooled by the cooler, the temperature of the electric power generator can be prevented from being raised, even if the working fluid supplied to the expansion mechanism has a high temperature. In addition, the demagnetization of the permanent magnet can be controlled if the permanent magnet is used in the electric power generator. Since the working fluid before supplied to the radiator is supplied to the inside of the sealed container, the working fluid in the gaseous phase is supplied to the inside of the sealed container. For this reason, the leak electric current can be prevented from being increased, and the lubricant oil mixed in the working fluid can be easily separated. As a result, the reliability of the Rankine cycle device using the sealed-type expansion machine is improved.

A second aspect according to the present disclosure provides the Rankine cycle device in which the second inlet and the second outlet are positioned closer to the electric power generator than the first outlet, in addition to the first aspect. In the second aspect, the temperature of the working fluid to cool the electric power generator can be prevented from being raised.

A third aspect according to the present disclosure provides the Rankine cycle device in which the second inlet is positioned closer to the electric power generator than the expansion mechanism, in addition to the first and second aspects. In the third aspect, the temperature of the working fluid near the second inlet can be prevented from being raised.

A fourth aspect according to the present disclosure provides the Rankine cycle device in which the second outlet is positioned closer to the electric power generator than the expansion mechanism, in addition to any one of the first to third aspects. In the fourth aspect, the temperature of the working fluid near the second outlet can be prevented from being raised.

A fifth aspect according to the present disclosure provides the Rankine cycle device in which the second inlet is positioned farther from the expansion mechanism than the second outlet, in addition to any one of the first to fourth aspects. In the fifth aspect, the temperature of the working fluid near the second inlet can be prevented from being raised due to heat transferred from the expansion mechanism.

A sixth aspect according to the present disclosure provides the Rankine cycle device in which the expansion machine further has a partition member for partitioning the inside space of the sealed container into the expansion mechanism and the electric power generator, in addition to any one of the first to fifth aspects. In the sixth aspect, the heat can be prevented from being transferred between the expansion mechanism and the periphery of the electric power generator.

A seventh aspect according to the present disclosure provides the Rankine cycle device in which the cooler cools the working fluid drained from the first outlet by exchanging the heat between the working fluid flowing through the cooling path and the working fluid flowing from the pump toward the heater, in addition to any one of the first to sixth aspects. In the seventh aspect, since the working fluid flowing through the flow path connecting the pump to the heater is heated in advance, the efficiency of the Rankine cycle device is improved.

An eighth aspect according to the present disclosure provides the Rankine cycle device in which the cooler cools the working fluid drained from the first outlet by exchanging the heat between the working fluid flowing through the cooling path and a heat medium outside the Rankine cycle device, in addition to any one of the first to sixth aspects. In the eighth aspect, the heat medium heated in the cooler is supplied to the outside.

A ninth aspect according to the present disclosure provides an expansion system comprising:

an expansion machine comprising:

an expansion mechanism for extracting a power from a working fluid heated by a heater, an electric power generator connected to the expansion mechanism, a sealed container containing the expansion mechanism and the electric power generator, a first inlet for supplying the working fluid to the expansion mechanism, a first outlet for draining the working fluid from the expansion mechanism to an outside of the sealed container, a second inlet for supplying, to an inside of the sealed container, the working fluid having a lower temperature than that of the working fluid at the first outlet, and a second outlet for draining, to the outside of the sealed container, the working fluid supplied from the second inlet; and a cooling path having a cooler for cooling the working fluid drained from the first outlet, the cooling path connecting the first outlet to the second inlet.

In the ninth aspect, provided is the expansion system which constitutes the Rankine cycle device according to any one of the first to eighth aspects. In other words, provided is the expansion system suitable for the configuration of the Ranking cycle device which ensures the high reliability.

A tenth aspect according to the present disclosure provides an expansion machine comprising:

an expansion mechanism for extracting a power from a working fluid heated by a heater, an electric power generator connected to the expansion mechanism, a sealed container containing the expansion mechanism and the electric power generator, a first inlet for supplying the working fluid to the expansion mechanism, a first outlet for draining the working fluid from the expansion mechanism to an outside of the sealed container, a second inlet for supplying, to an inside of the sealed container, the working fluid having a lower temperature than that of the working fluid at the first outlet, and a second outlet for draining, to the outside of the sealed container, the working fluid supplied from the second inlet.

In the tenth aspect, provided is the expansion machine which constitutes the Rankine cycle device according to any one of the first to eighth aspects. In other words, provided is the expansion machine suitable for the configuration of the Ranking cycle device which ensures the high reliability.

An eleventh aspect according to the present disclosure provides the expansion machine in which the second inlet is positioned farther from the expansion mechanism than the second outlet, in addition to the tenth aspect. In the eleventh aspect, the temperature of the working fluid near the second inlet can be prevented from being raised due to heat transferred from the expansion mechanism.

The embodiments of the present invention will be described below with reference to the drawings. Note that the following description is one example of the present invention. The present invention is not limited to the following description.

First Embodiment (Configuration of the Rankine Cycle Device)

As shown in FIG. 1, a Rankine cycle device 100*a* has a pump 1, a heater 2, an expansion machine 3, a cooler 4, a radiator 5, and a plurality of flow paths 6*a*-6*g* which connect these. Each flow path 6*a*-6*g* is formed of a ductwork. The flow paths 6*a*-6*g* may be referred to first-seventh flow paths, respectively.

The pump 1 sucks the working fluid to pressurize it. For example, the pump 1 is a displacement pump or a turbo pump. An example of the displacement pump is a piston pump, a gear pump, a vane pump, or a rotary pump. An example of the turbo pump is a centrifugal pump, a mixed flow pump, or an axial flow pump. The pump 1 is connected to the cooler 4 with the flow path 6*a*.

The heater 2 heats the working fluid pressurized by the pump 1. A heat medium such as high-temperature water heated by geothermal heat, combustion gas from a boiler or a furnace, or an exhaust gas thereof flows in the heater 2. The heater 2 heats and evaporates the working fluid with the thermal energy the heat medium has. In the case where the heat medium is a liquid such as high-temperature water, for example, the heater 2 is a plate heat exchanger or a double-pipe heat exchanger. In addition, in the case where the heat medium is a gas such as a combustion gas, for example, the heater 2 is a fin tube type heat exchanger. The heater 2 is connected to the cooler 4 with the flow path 6*b*.

The expansion machine 3 has an expansion mechanism 11, an electric power generator 12, a shaft 13, a sealed container 10, a first inlet 34*a*, a first outlet 35*a*, a second inlet 30*a*, and a second outlet 31*a*. The expansion mechanism 11 expands the working fluid heated by the heater 2. The expansion mechanism 11 extracts a power from the working fluid heated by the heater 2. The electric power generator 12 is connected to the expansion mechanism 11 with the shaft 13. In this way, the electric power generator 12 is driven by the power extracted from the working fluid in the expansion mechanism 11.

The sealed container 10 contains the expansion mechanism 11 and the electric power generator 12. A first inlet 34*a* is provided to supply the working fluid heated by the heater 2 to the expansion mechanism 11. A first outlet 35*a* is provided to drain the working fluid from the expansion mechanism 11 to the outside of the sealed container 10. A second inlet 30*a* is provided to supply the working fluid having a lower temperature than that of the working fluid at the first outlet 35*a* to the inside of the sealed container 10. A second outlet 31*a* is provided to drain the working fluid supplied from the second inlet 30*a* to the outside of the sealed container. The expansion machine 3 is connected to the heater 2 with the flow path 6*c*. The expansion machine 3 is connected to the cooler 4 with the flow path 6*d* and the flow path 6*e*. In addition, the expansion machine 3 is connected to the radiator 5 with the flow path 6*f*.

The radiator 5 is connected to the pump 1 with the flow path 6*g*, and the radiator 5 cools the working fluid drained from the second outlet 31*a*. In the radiator 5, the heat medium is heated by exchanging heat between the heat medium and the working fluid to cool the working fluid. The radiator 5 is a known heat exchanger such as a plate heat exchanger, a double-pipe heat exchanger, the fin tube type heat exchanger. The radiator 5 is selected appropriately depending on the kind of the heat medium which is used to cool the working fluid. In the case where the heat medium is a liquid such as water, for example, the radiator 5 is a plate heat exchanger or a double-pipe heat exchanger. In addition, in the case where the heat medium is a gas such as an air, for example, the radiator 5 is a fin tube type heat exchanger.

The Rankine cycle device 100*a* comprises a cooling path 8 that connects the second inlet 30*a* to the first outlet 35*a*. The cooling path 8 has the cooler 4. In other words, the cooling path 8 is constructed with the flow path 6*d*, the cooler 4, and the flow path 6*e*. The cooler 4 cools the working fluid drained from the first outlet 35*a*. In particular, the cooler 4 exchanges heat between the working fluid flowing through the cooling path 8 and the working fluid flowing through the flow path from the outlet of the pump 1 to the inlet of the heater 2. For example, the cooler 4 is a plate heat exchanger or a double pipe heat exchanger.

An expansion system 50*a* includes a portion of the configuration of the Rankine cycle device 100*a*. The expansion system 50*a* comprises the expansion machine 3 and the cooling path 8.

The working fluid for the Rankine cycle device 100*a* is not limited particularly; however, it may be an organic working fluid, namely, an organic compound. The organic working fluid is, for example, halogenated hydrocarbon, hydrocarbon or alcohol. For example, the halogenated hydrocarbon is R-123 or R-245fa. For example, hydrocarbon is alkane such as propane, butane, pentane, or isopentane. For example, alcohol is ethanol. These organic working fluids may be used alone. A mixture of two kinds of these organic working fluids may be used. In addition, an inorganic working fluid such as water, carbon dioxide, or ammonia may be used.

(Configuration of the Expansion Machine)

Figure 2:
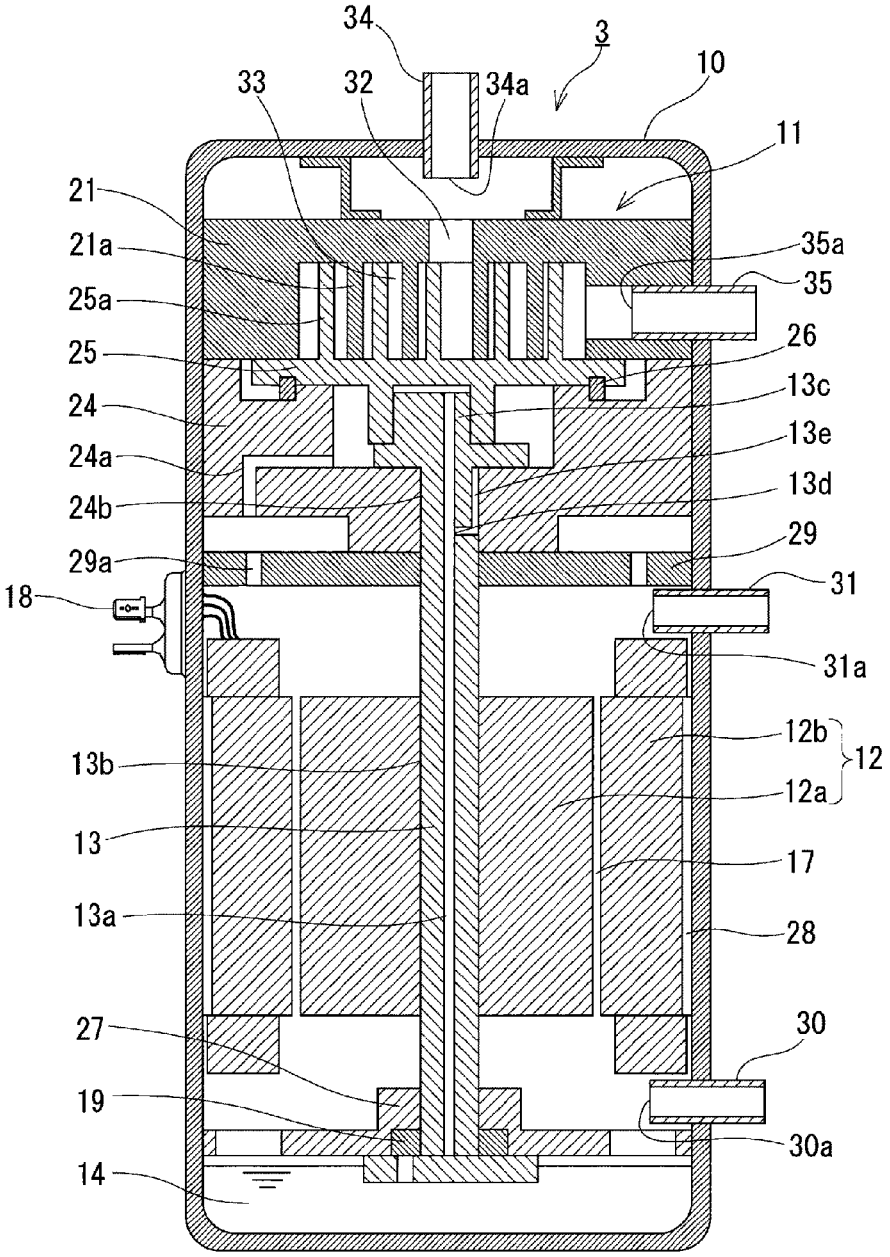
FIG. 2 shows a vertical cross-sectional view of an expansion machine of FIG. 1.

As shown in FIG. 2, in the sealed container 10 of the expansion machine 3, the expansion mechanism 11 is disposed at the upper portion thereof, whereas the electric power generator 12 is disposed at the lower portion thereof. An oil pump 19 is provided at the lower part of the electric power generator 12. The expansion mechanism 11, the electric power generator 12, and the oil pump 19 are connected uniaxially with the shaft 13. The shaft 13 runs in a vertical direction. In other words, the expansion machine 3 is a longitudinal expansion machine in which the electric power generator 12 is connected to the expansion mechanism 11 with the shaft 13 which runs in the vertical direction.

In the present embodiment, the expansion mechanism 11 is a scroll-type fluid mechanism. The expansion mechanism 11 is not limited to a scroll type one, and may be a fluid mechanism such as a rotary-type fluid mechanism including a rolling piston type one and a sliding vane type one, a reciprocating fluid mechanism, or a screw type fluid mechanism. Furthermore, the expansion mechanism 11 is not limited to a displacement fluid mechanism, and may be a centrifugal fluid mechanism.

As shown in FIG. 2, the expansion mechanism 11 comprises a fixed scroll 21, a swirl scroll 25, and a main bearing 24. The main bearing 24 is fixed to the inner lateral surface of the sealed container 10 by a welding method or a thermal insert method. The main bearing 24 supports a main shaft portion 13*b* of the shaft 13. In addition, the main bearing 24 has a lubricant oil passage 24*a*.

The fixed scroll 21 is fixed to the main bearing 24 with a bolt (not shown). The swirl scroll 25 is positioned between the main bearing 24 and the fixed scroll 21, and is fitted to an eccentric shaft portion 13*c* formed at the upper end of the shaft 13. A rotation regulative mechanism 26 such as an Oldham ring is provided between the main bearing 24 and the swirl scroll 25. The rotation regulative mechanism guides the swirl scroll 25 so as to prevent the swirl scroll 25 from being rotated and so as to promote a rotary motion of the swirl scroll 25. The fixed scroll 21 and the swirl scroll 25 comprise a spiral lap 21*a* and a spiral 25*a*, respectively. The spiral lap 21 and the spiral lap 25 are engaged to each other. In this way, an expansion room 33 is formed between the fixed scroll 21 and the swirl scroll 25.

Furthermore, the expansion machine 3 has a first supply tube 34 and a first drain tube 35. The first supply tube 34 is provided so as to penetrate the sealed container 10 at the upper portion of the fixed scroll 21. The first inlet 34*a* is formed of the first supply tube 34. The expansion room 33 is communicated to the flow path 6*c* through the first supply tube 34. The first drain tube 35 is provided so as to penetrate the sealed container 10 at the lateral portion of the expansion mechanism 11. The first outlet 35*a* is formed of the first drain tube 35. The expansion room 33 is communicated to the cooling path 8 through the first drain tube 35. The working fluid is supplied directly to the expansion room 33 through the first supply tube 34 without going through the space peripheral to the electric power generator 12. In addition, the working fluid is drained directly outside the expansion machine 3 through the first drain tube 35 without going through the space peripheral to the electric power generator 12.

As shown in FIG. 2, the lower end of the main shaft portion 13*b* is supported by a counter bearing 27. The oil pump 19 is provided at the lower end of the main shaft portion 13*b*. A storing portion 14 for storing the lubricant oil is formed at the bottom of the inside of the sealed container 10. The oil pump 19 is immersed in the storing portion 14. In addition, the shaft 13 is provided with an oil path 13*a* which runs in the axial direction of the shaft 13. The phrase "running in the axial direction of the shaft 13" means that the oil path 13*a* is extended as a whole along the axial direction of the shaft 13. In the present embodiment, the oil path 13*a* is extended along the axial direction of the shaft 13 in the inside of the shaft 13.

The shaft 13 has an oil supply hole 13*d* for supplying the lubricant oil included in the oil path 13*a* to a sliding portion 24*b* where the main bearing 24 slides with the shaft 13. Furthermore, an oil groove 13*e* is provided on the outer lateral surface of the shaft 13 in the sliding portion 24*b* so that the lubricant oil flows upwardly by the action of the rotation of the shaft 13.

The electric power generator 12 is positioned between the main bearing 24 and the counter bearing 27. The electric power generator 12 is constituted with a rotor 12*a* fixed to the shaft 13 and a stator 12*b* disposed around the rotor 12*a*. The electric power generated by the electric power generator 12 is transmitted to the electric power unit (not shown) such as a convertor through a terminal 18 provided at the outer lateral surface of the sealed container 10. An interspace 17 through which the working fluid in the gaseous phase goes is formed between the rotor 12*a* and the stator 12*b*. A communication path 28 which communicates the upper space of the electric power generator 12 to the lower space of the electric power generator 12 is formed between the stator 12*b* and the sealed container 10. The communication path 28 may be formed so as to penetrate the stator 12*b*.

The expansion machine 3 has a partition member 29 which partitions the internal space of the sealed container 10 into the expansion mechanism 11 and the electric power generator 12. In particular, the partition member 29 is disposed between the main bearing 24 and the electric power generator 12. The partition member 29 is fixed to the lower part of the main bearing 24 with a bolt (not shown) and extends from the shaft 13 to the internal lateral surface of the sealed container 10. The partition member 29 may be fixed to the sealed container 10 by a thermal insert method or using a bolt. The material of the partition member 29 is not limited. An example of the material of the partition member 29 is iron steel or cast iron. Another example is stainless, ceramic, or thermally-resistant plastic, which exhibit low heat conductivity.

Furthermore, the expansion machine 3 has a second supply tube 30 and a second drain tube 31. The second supply tube 30 and the second drain tube 31 are each provided so as to penetrate the sealed container 10. The second inlet 30*a* is formed of the second supply tube 30. The second outlet 31*a* is formed of the second drain tube 31. The second supply tube 30 and the second drain tube 31 are located closer to the electric power generator 12 than the first drain tube 35. For this reason, the second inlet 30*a* and the second outlet 31*a* are located closer to the electric power generator 12 than the first outlet 35*a*.

As shown in FIG. 2, the second inlet 30*a* is located closer to the electric power generator 12 than the expansion mechanism 11. In addition, the second outlet 31*a* is located closer to the electric power generator 12 than the expansion mechanism 11. Furthermore, the second inlet 30*a* is located father from the expansion mechanism 11 than the second outlet 31*a*. In particular, the second inlet 30*a* is located between the bottom of the electric power generator 12 and the storing portion 14. The second outlet 31*a* is located between the upper end of the electric power generator 12 and the main bearing 24. In addition, the second outlet 31*a* is located between the upper end of the electric power generator 12 and the partition member 29.

The lubricant oil stored in the storing portion 14 is pumped by the oil pump 19, and forwarded upwardly through the oil path 13*a*. The lubricant oil forwarded upwardly is supplied to the expansion mechanism 11 through the upper end of the shaft 13. In this case, a portion of the lubricant oil is supplied to the sliding portion 24*b* through the oil supply hole 13*d* of the shaft 13. The lubricant oil supplied to the sliding portion 24*b* is forwarded along the oil groove 13*e* and supplied to the expansion mechanism 11. The lubricant oil supplied to the expansion mechanism 11 flows into the upper part of the partition member 29 through the lubricant oil passage 24*a*. Then, the lubricant oil is returned to the storing portion 14 through a communication hole 29*a* and the communication path 28.

(Operation of the Rankine Cycle Device)

Figure 3:
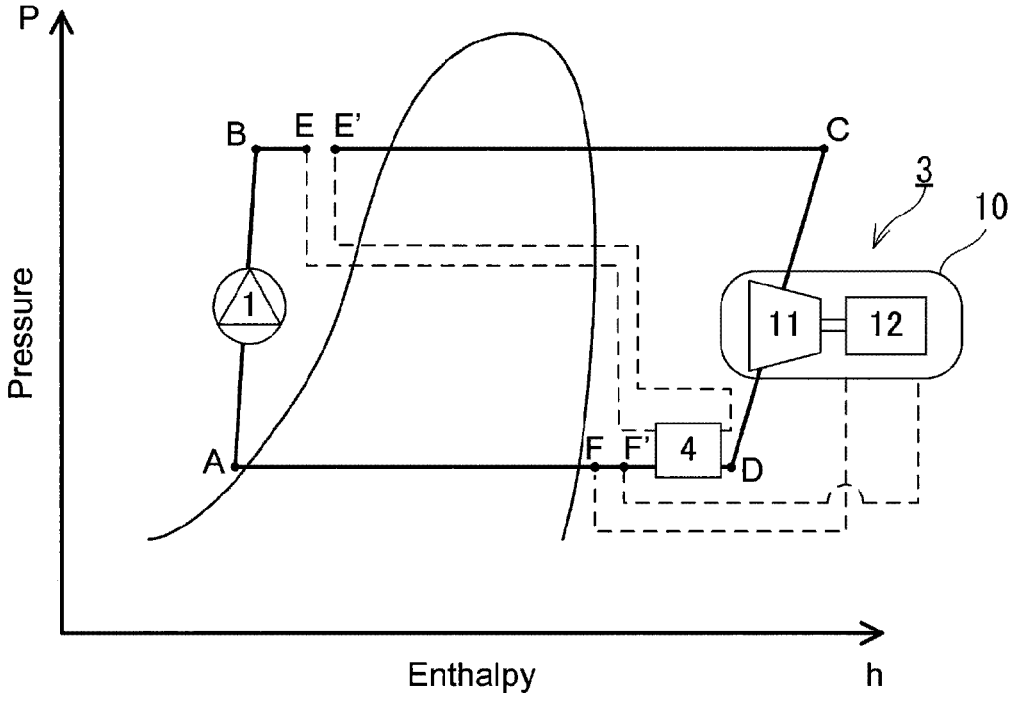
FIG. 3 shows a graph showing a relation between a pressure and an enthalpy in the Rankine cycle device shown in FIG. 1.

Next, the operation of the Rankine cycle device will be described below. As shown in FIG. 3, the state of the working fluid included in the Rankine cycle device varies on the graph showing the relation between the pressure and the enthalpy (hereinafter, referred to as "p-h graph") in the order of A, B, E, E', C, D, F, F', and A.

The working fluid is pressurized by the pump 1 to vary from the state A to the state B. The working fluid pressurized by the pump 1 is led to the cooler 4 through the flow path 6*a*. The working fluid which has been in the state E at the inlet of the cooler 4 flows inside the cooler 4. In the cooler 4, the working fluid is heated by heat exchange with the working fluid flowing from the first outlet 35*a* to the second inlet 30*a*. For this reason, the state of the working fluid varies from the state E to the state E' to raise the enthalpy of the working fluid. In the present embodiment, the working fluid in the state E or in the state E' is a supercooled liquid. Next, the working fluid is supplied to the heater 2 through the flow path 6*b*. Since the working fluid is heated by the heater 2, the enthalpy of the working fluid is raised. For this reason, the state of the working fluid varies from the state E' to the state C. The working fluid in the state C is a superheated steam and is in the gaseous phase state having a high temperature and a high pressure.

Then, the working fluid is supplied to the expansion mechanism 11 through the flow path 6*c* and the first inlet 34*a*. The power is extracted from the working fluid by expanding the working fluid in the expansion mechanism 11. In particular, the working fluid which has been supplied to the expansion mechanism 11 through the first inlet 34*a* is sucked to the expansion room 33 through an inhalation hole 32 formed at the center of the fixed scroll 21. The volume of the expansion room 33 is increased in the expansion room 33 by expanding the working fluid. In particular, the swirl scroll 25 makes eccentric rotational motion so that the swirl scroll 25 rotates eccentric axis portion 13*c* of the shaft 13 together with the expansion of the working fluid. In this way, the volume of the expansion room 33 is increased. In this case, the expansion room 33 is moved from the center of the expansion mechanism 11 toward the outer lateral surface of the expansion mechanism 11. This rotation power rotates the rotor 12*a* of the electric power generator 12 through the shaft 13. In this way, the electric power generator 12 generates an electric power.

Figure 4:
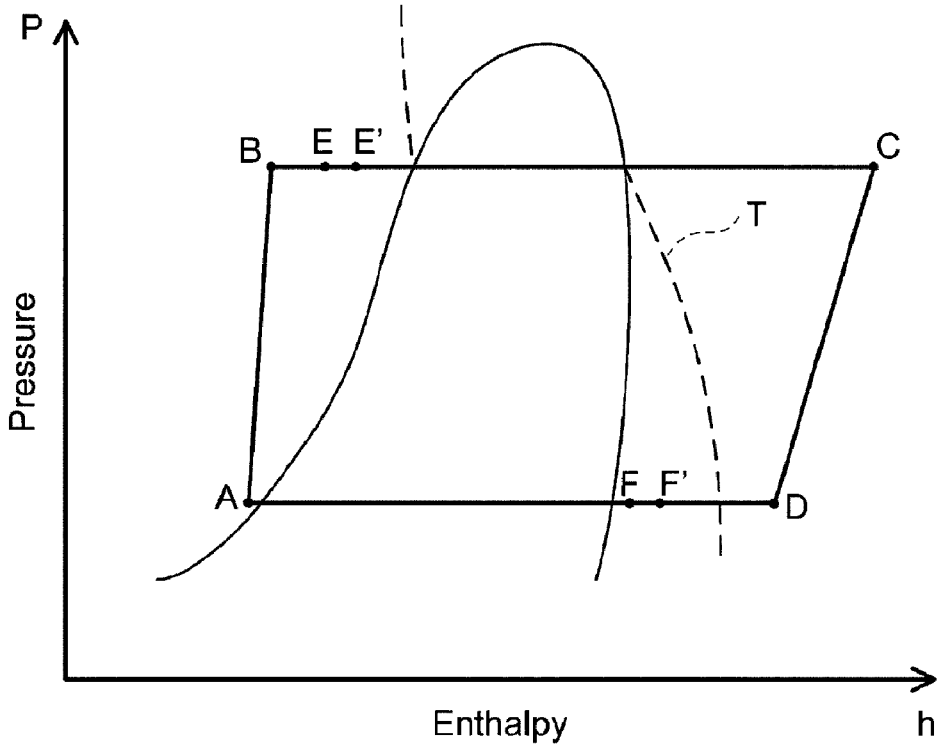
FIG. 4 shows a graph showing a relation between the pressure and the enthalpy in the Rankine cycle device shown in FIG. 1.

The working fluid expanded in the expansion room 33 is drained directly to the outside of the sealed container 10 through the first outlet 35*a* without going through the space peripheral to the electric power generator 12. In this case, the pressure of the working fluid is deceased due to the expansion of the working fluid. For this reason, the state of the working fluid varies from the state C to the state D. The working fluid in the state D is a superheated steam, and the working fluid in the state D is in a low pressure gaseous phase state having a middle-level temperature in the cycle. As shown in FIG. 4, the temperature of the working fluid in the state D is, for example, higher than the saturated temperature of the working fluid under a high pressure of the Rankine cycle. Note that the curve T shown in FIG. 4 indicates an isotherm line. In other words, the working fluid supplied to the expansion mechanism 11 also has a high temperature. In other words, the temperature of the working fluid at the first inlet 34*a* is set so that the temperature of the working fluid at the first outlet 35*a* is higher than the saturated temperature under the high pressure of the cycle. When the temperature of the working fluid is raised, the efficiency of the Rankine cycle is also improved; however, the temperature of the expansion mechanism 11 gets high. For this reason, it is required to cool the electric power generator 12. Accordingly, the effectiveness of the Rankine cycle device according to the present embodiment is raised in the case where the high temperature working fluid is supplied to the expansion machine 3.

Then, the working fluid is supplied to the cooler 4 through the flow path 6*d*. Heat is exchanged between this working fluid and the working fluid supplied to the cooler 4 through the flow path 6*a*. In this way, the working fluid supplied to the cooler 4 through the flow path 6*d* is cooled, and the state of the working fluid varies from the state D to the state F. The working fluid in the state F is in a gaseous phase state having a lower temperature than the temperature of the working fluid at the first outlet 35*a*. As just described, it is desirable that the amount of the heat the working fluid flowing through the cooling path 8 in the cooler 4 loses is determined so that the working fluid at the second inlet 30*a* exhibits the gaseous phase state. This working fluid is supplied to the inside of the sealed container 10 through the flow path 6*e* and the second inlet 30*a*. The working fluid flows in the inside of the sealed container 10 to cool the electric power generator 12. On the other hand, the working fluid is heated by the electric power generator 12. Then, the working fluid is drained to the outside of the sealed container 10 through the second outlet 31*a*. Since the working fluid is heated by the electric power generator 12, the state of the working fluid varies from in the state F to the state F'.

Then, the working fluid is supplied to the radiator 5 through the flow path 6*f*. The working fluid is cooled by the radiator 5. For this reason, the state of the working fluid varies from the state F' to the state A. Then, the working fluid is drained from the radiator 5. Finally, the working fluid is sucked to the pump 1 through the flow path 6*g*.

(Cooling of the Electric Power Generator)

Next, the cooling of electric power generator 12 will be described. As described above, since the periphery of the expansion mechanism 11 is under a high temperature state, it is desirable to cool the electric power generator 12 in order to prevent the electric power generator 12 from being damaged and in order to improve the reliabilities of the expansion machine 3 and the Rankine cycle device 100*a*. For this reason, in the present embodiment, the working fluid flowing through the cooling path 8 connecting the first outlet 35*a* to the second inlet 30*a* is cooled by the cooler 4 provided in the cooling path 8. The working fluid thus cooled is supplied to the inside of the sealed container 10. In particular, the working fluid is supplied to the position below the electric power generator 12 in the inside of the sealed container 10 and above the storing portion 14 or the oil pump 19, through the second inlet 30*a*. In this case, the pressure of the working fluid is lower than that of the working fluid at the first outlet 35*a* due to pressure loss in the flow path 6*d* or the cooler 4. The working fluid flows upwardly between the rotor 12*a* and the stator 12*b* through the interspace 17. In this way, the electric power generator 12 is cooled by the working fluid. Then, the working fluid reaches the space above the electric power generator 12 and below the partition member 29. Next, the working fluid is drained to the outside of the sealed container 10 through the second outlet 31*a*.

As described above, the periphery of the electric power generator 12 is filled with the working fluid having lower temperature and lower pressure than the working fluid at the first outlet 35*a*. In addition, the high temperature working fluid supplied to the expansion mechanism 11 through the first inlet 34*a* is drained to the outside of the sealed container 10 without going through the space peripheral to the electric power generator 12. For this reason, the high temperature working fluid supplied to the expansion mechanism 11 is not brought into contact with the electric power generator 12. As a result, the temperature of the electric power generator 12 is prevented from being raised. Since the working fluid having a high temperature over the upper temperature limit of the electric power generator 12 can be supplied to the expansion mechanism 11, the efficiency of the Rankine cycle is improved. As a result, the high efficiency of the cycle is achieved, and the electric power generation is prevented from being damaged. If the permanent magnet is used in the electric power generator 12, the demagnetization of the permanent magnet is prevented.

In the configuration described above, the working fluid in the gaseous phase state can be supplied to the inside of the sealed container 10 through the second inlet 30*a*. For this reason, even when the lubricant oil is mixed into the working fluid on the periphery of the electric power generator 12, the working fluid is centrifuged from the lubricant oil by the rotation of the rotor 12*a* due to the density difference between the working fluid and the lubricant oil, when the working fluid goes through the electric power generator 12. In this way, since the concentration of the lubricant oil contained in the working fluid is lowered, thermal decomposition or deterioration of the lubricant oil which occurs by heating the lubricant oil with the heater 2 is prevented. This also allows the amount of the lubricant oil circulating through the flow paths 6*a*-6*e* to be decreased. In addition, decreased is the loss which occurs by stirring the working fluid with the rotor 12*a*. Since the working fluid in the gaseous phase state has higher electrical resistance than the working fluid in the liquid phase state, the leak electric current can be decreased.

Since the working fluid supplied to the inside of the sealed container 10 through the second inlet 30*a* cools the lubricant oil, the temperature of the lubricant oil is prevented from being raised. This allows the lubricant oil to be prevented from being deteriorated due to the temperature raise.

The periphery of the electric power generator 12 is filled with the low temperature working fluid in the gaseous phase state flowing from the second inlet 30*a* to the second outlet 31*a*. As described above, since the second inlet 30*a* and the second outlet 31*a* are positioned closer to the electric power generator 12 than the first outlet 35*a*, the temperature of the working fluid around the electric power generator 12 is prevented from being raised. Since the second inlet 30*a* is positioned closer to the electric power generator 12 than the expansion mechanism 11, the temperature of the working fluid near the second inlet 30*a* is prevented from being raised. Since the second outlet 31*a* is positioned closer to the electric power generator 12 than the expansion mechanism 11, the temperature of the working fluid near the second outlet 31*a* is prevented from being raised. In such a configuration, the working fluid supplied to the inside of the sealed container 10 through the second inlet 30*a* is prevented from flowing near the expansion mechanism 11. For this reason, the heat around the expansion mechanism 11 in the high temperature state is prevented from being transferred along the flow of the working fluid to the electric power generator 12. In this way, the efficiency of the cycle is improved, and the electric power generator 12 is prevented from being damaged.

In addition, the second inlet 30*a* is positioned farther from the expansion mechanism 11 than the second outlet 31*a*. The working fluid supplied through the second inlet 30*a* is heated by the electric power generator 12 and drained from the second outlet 31*a*, when the working fluid flows around the electric power generator 12. For this reason, the temperature of the working fluid near the second outlet 31*a* is higher than the temperature of the working fluid near the second inlet 30*a*. In this configuration, the temperature of the working fluid near the second inlet 30*a* is prevented from being raised due to heat transferred from the expansion mechanism. As a result, the electric power generator 12 is sufficiently cooled, and the electric power generator 12 is prevented from being damaged.

The partition member 29 prevents the working fluid accumulated above the partition member 29 in the inside of the sealed container 10 from being positively mixed with the working fluid below the partition member 29 in the inside of the sealed container 10. For this reason, the working fluid below the partition member 29 is maintained at a low temperature. Since the low temperature working fluid is accumulated around the electric power generator 12, the temperature raise of the electric power generator 12 is prevented from being raised. Furthermore, since the partition member 29 prevents the heat transfer from the working fluid accumulated above the partition member 29, the working fluid accumulated above the partition member 29 is maintained at a high temperature. For this reason, since the heat transfer from the expansion mechanism 11 is prevented, the expansion mechanism 11 is maintained at a high temperature state. As a result, the high efficiency of the cycle is achieved. In addition, in a case where the material of the partition member 29 is, for example, stainless steel, ceramic, or thermally-resistant plastic, the heat transfer from the working fluid accumulated above the partition member 29 or from the expansion mechanism 11 to the space below the partition member 29 is further prevented.

(Variation)

The present embodiment can be varied from a number of different perspectives. For example, in the inside of the sealed container 10 of the expansion machine 3, the electric power generator 12 may be positioned at the upper part, and the expansion mechanism 11 may be positioned at the lower part. The expansion machine 3 is a horizontal expansion machine in which the electric power generator 12 is connected to the expansion mechanism 11 with the shaft 13 which runs in the horizontal direction.

The second inlet 30*a* may be positioned closer to the expansion mechanism 11 than the second outlet 31*a*. In addition, the distance from the second inlet 30*a* to the expansion mechanism 11 may be equal to the distance from the second outlet 31*a* to the expansion mechanism 11. The second inlet 30*a* and the second outlet 31*a* may be extended in the same direction or in the reverse direction in the circumferential direction of the shaft 13.

A through hole which passes through the rotor 12*a* in a direction parallel to the longitudinal direction of the shaft 13, namely, the rotation axis of the shaft 13, may be formed on the rotor 12*a*. In this case, the working fluid flows through the interspace 17 or this through hole toward the upper space of the electric power generator 12. In this way, the electric power generator 12 is cooled by the working fluid.

Second Embodiment

Next, a Rankine cycle device 100*b* according to the second embodiment will be described. Unless otherwise specified, the Rankine cycle device 100*b* according to the second embodiment has the same structure as one according to the first embodiment. Each of the elements included in the Rankine cycle device 100*b* according to the second embodiment has the same reference number as one according to the first embodiment to omit the detailed description. In other words, the description in the first embodiment including the variation thereof is applied to the present embodiment, as long as the description in the second embodiment does not contradict one in the first embodiment.

Figure 5:
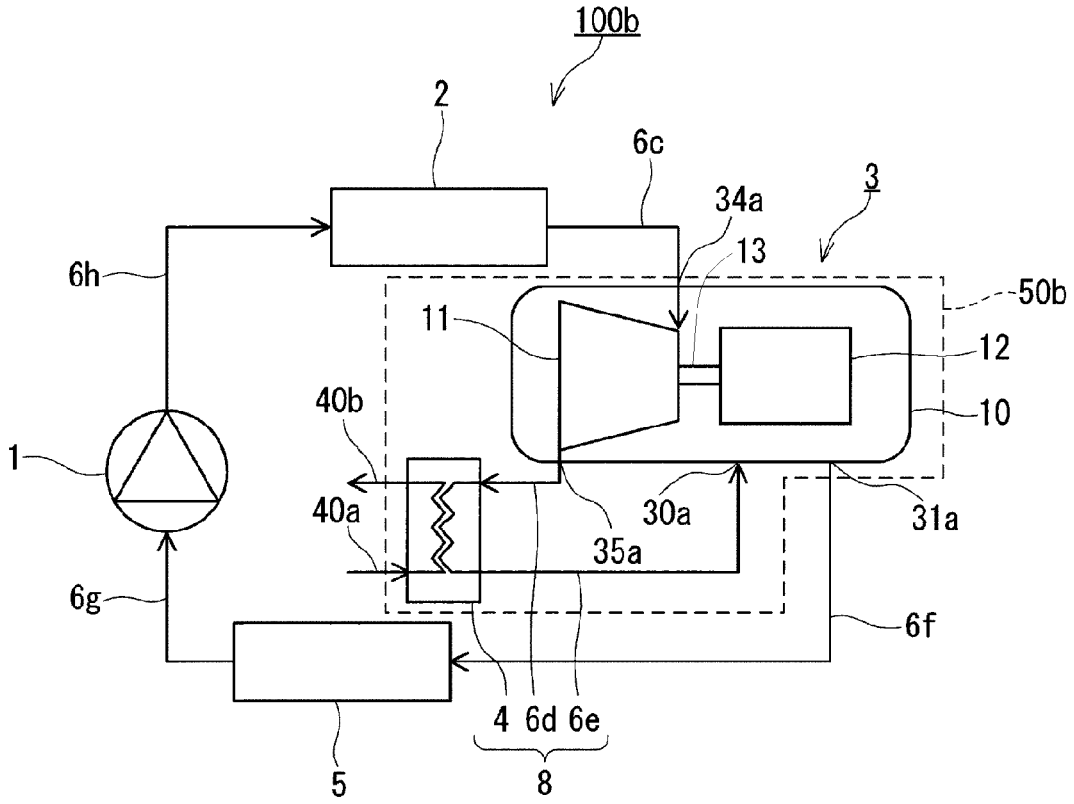
FIG. 5 shows a structural view of a Rankine cycle device according to a second embodiment of the present disclosure.
Figure 6:
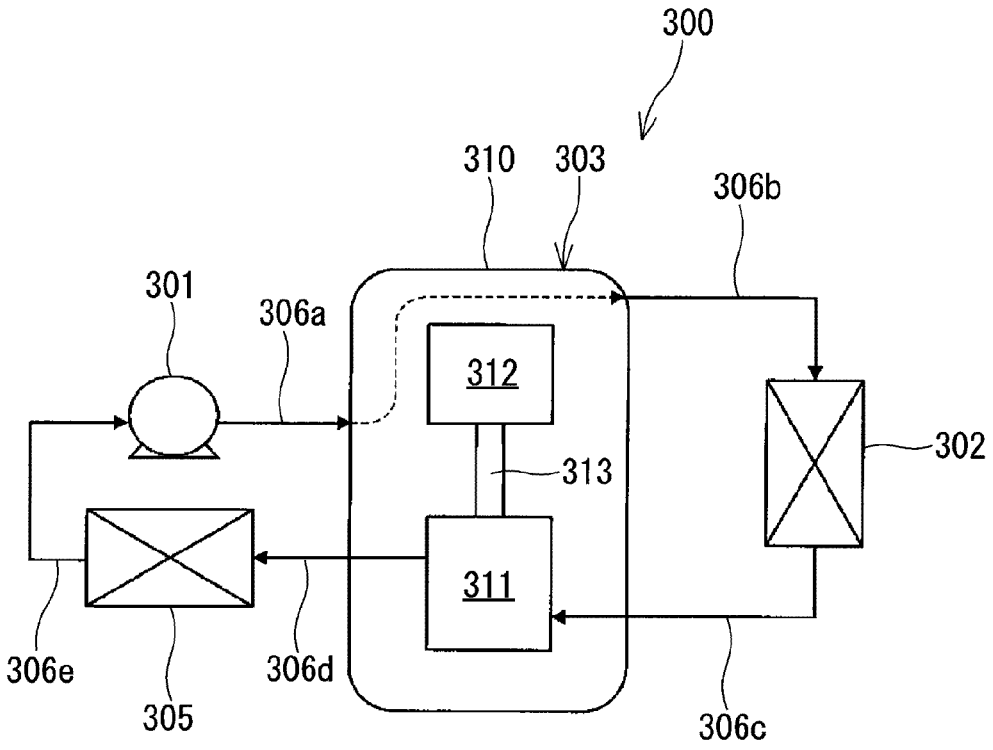
FIG. 6 shows a structural view of a conventional Rankine cycle device.

As shown in FIG. 5, the cooler 4 included in the Rankine cycle device 100*b* cools the working fluid drained from the first outlet 35*a* by exchanging heat between the working fluid flowing through the cooling path 8 and an heat medium supplied from the outside of the Rankine cycle. In this regard, the Rankine cycle device 100*b* is different from the Rankine cycle device 100*a*. The heat medium supplied from the outside of the Rankine cycle is supplied to the cooler 4 through a flow path 40*a*. This heat medium cools the working fluid flowing through the cooling path 8 by flowing through the cooler 4. On the other hand, this heat medium is heated by the working fluid in the cooler 4. Then, the heat medium is drained from the cooler 4, and flows through a flow path 40*b*. The heat medium is, for example, water or air.

A known heat exchanger can be used as the cooler 4. In the case where the heat medium is a liquid such as water, for example, the cooler 4 is a plate heat exchanger or a double-pipe heat exchanger. In addition, in the case where the heat medium is a gas such as an air, for example, the cooler 4 is a fin tube type heat exchanger. In the present embodiment, the flow path 40*a* and the flow path 40*b* connected to the cooler 4, and cooling water flows as the heat medium. The working fluid drained from the first outlet 35*a* is supplied to the cooler 4 through the flow path 6*d*. The working fluid is cooled by the cooling water in the cooler 4. Furthermore, the working fluid is supplied to the inside of the sealed container 10 through the flow path 6*e* and the second inlet 30*a*.

In this configuration, the electric power generator 12 is cooled by the working fluid cooled in the cooler 4. For this reason, the effects similar to those in the first embodiment are obtained. In addition, since the cooling water supplied to the cooler 4 through the flow path 40*a* is heated, the heated cooling water can be supplied to the outside of the Rankine cycle device 100*b*. It is desirable that the amount of the heat the working fluid loses in the cooler 4 is determined so that the working fluid at the second inlet 30*a* exhibits the gaseous phase state.

In the Rankine cycle device 100*b*, the outlet of the pump 1 is connected directly to the inlet of the heater 2 with the flow path 6*h*. In addition, the expansion system 50*b* is configured with the expansion machine 3 and the cooling path 8.

INDUSTRIAL APPLICABILITY

The Rankine cycle device of the present disclosure can be used for a thermoelectric power generation system.

REFERENCE SIGNS LIST

1 Pump
2 Heater
3 Expansion machine
4 Cooler
5 Radiator
6*a*-6*c* Flow path
8 Cooling path
10 Sealed container
11 Expansion mechanism
12 Electric power generator
29 Partition member
30*a* Second inlet
31*a* Second outlet
34*a* First inlet
35*a* First outlet
50*a*, 50*b* Expansion system
100*a*, 100*b* Rankine cycle device

The invention claimed is:

1. A Rankine cycle device comprising:

a pump for pressurizing a working fluid;

a heater for heating the working fluid pressurized by the pump;

an expansion machine comprising:

an expansion mechanism for extracting a power from the working fluid heated by the heater, an electric power generator connected to the expansion mechanism, a sealed container containing the expansion mechanism and the electric power generator, a first inlet for supplying the working fluid to the expansion mechanism, a first outlet for draining the working fluid from the expansion mechanism to an outside of the sealed container, a second inlet for supplying, to an inside of the sealed container, the working fluid having a lower temperature than that of the working fluid at the first outlet, and a second outlet for draining, to the outside of the sealed container, the working fluid supplied from the second inlet;

a radiator for cooling the working fluid drained from the second outlet and for supplying the working fluid to the pump; and a cooling path having a cooler for cooling the working fluid drained from the first outlet, the cooling path connecting the first outlet to the second inlet.

2. The Rankine cycle device according to claim 1, wherein the second inlet and the second outlet are positioned closer to the electric power generator than the first outlet.

3. The Rankine cycle device according to claim 1, wherein the second inlet is positioned closer to the electric power generator than the expansion mechanism.

4. The Rankine cycle device according to claim 1, wherein the second outlet is positioned closer to the electric power generator than the expansion mechanism.

5. The Rankine cycle device according to claim 1, wherein the second inlet is positioned farther from the expansion mechanism than the second outlet.

6. The Rankine cycle device according to claim 1, wherein the expansion machine further has a partition member for partitioning the inside space of the sealed container into the expansion mechanism and the electric power generator.

7. The Rankine cycle device according to claim 1, wherein the cooler cools the working fluid drained from the first outlet by exchanging the heat between the working fluid flowing through the cooling path and the working fluid flowing from the pump toward the heater.

8. The Rankine cycle device according to any one of claim 1, wherein the cooler cools the working fluid drained from the first outlet by exchanging the heat between the working fluid flowing through the cooling path and a heat medium outside the Rankine cycle device.

9. An expansion system comprising:

an expansion machine comprising:

an expansion mechanism for extracting a power from a working fluid heated by a heater, an electric power generator connected to the expansion mechanism, a sealed container containing the expansion mechanism and the electric power generator, a first inlet for supplying the working fluid to the expansion mechanism, a first outlet for draining the working fluid from the expansion mechanism to an outside of the sealed container, a second inlet for supplying, to an inside of the sealed container, the working fluid having a lower temperature than that of the working fluid at the first outlet, and a second outlet for draining, to the outside of the sealed container, the working fluid supplied from the second inlet;

a cooling path having a cooler comprising a heat exchanger for cooling the working fluid drained from the first outlet, the cooling path connecting the first outlet to the second inlet, and the second inlet and the second outlet are connected to the electric power generator of the sealed container.

10. An expansion machine comprising:

an expansion mechanism for extracting a power from a working fluid heated by a heater;

an electric power generator connected to the expansion mechanism;

a sealed container containing the expansion mechanism and the electric power generator;

a first inlet for supplying the working fluid to the expansion mechanism;

a first outlet for draining the working fluid from the expansion mechanism to an outside of the sealed container;

a second inlet for supplying, to an inside of the sealed container, the working fluid having a lower temperature than that of the working fluid at the first outlet; and a second outlet for draining, to the outside of the sealed container, the working fluid supplied from the second inlet, wherein the second inlet and the second outlet are connected to the electric power generator of the sealed container, and the working fluid at the first inlet has a higher pressure than that of the working fluid at the second outlet during operation of the expansion machine.

11. The expansion machine according to claim 10, wherein the second inlet is positioned farther from the expansion mechanism than the second outlet.

12. The Rankine cycle device according to claim 1, wherein the working fluid at the second inlet supplied to the inside of the sealed container is in a gaseous phase.

13. The Rankine cycle device according to claim 1, wherein the cooler comprises a heat exchanger.

14. The expansion system according to claim 9, wherein the working fluid at the second inlet supplied to the inside of the sealed container is in a gaseous phase.

15. The expansion machine according to claim 10, wherein the working fluid at the second inlet supplied to the inside of the sealed container is in a gaseous phase.

16. The expansion system according to claim 9, wherein the heat exchanger is arranged such that heat exchange therein occurs between working fluid drained from the first outlet and working fluid flowing to the first inlet.

17. The Rankine cycle device according to claim 1, wherein the working fluid at the first inlet has a higher pressure than that of the working fluid at the second outlet during operation of the expansion machine.

18. The expansion system according to claim 9, wherein the working fluid at the first inlet has a higher pressure than that of the working fluid at the second outlet during operation of the expansion machine.

* * * * *